US009945402B2

(12) United States Patent
Typinski et al.

(10) Patent No.: US 9,945,402 B2
(45) Date of Patent: Apr. 17, 2018

(54) INTERNAL POSITION SENSOR

(71) Applicant: BorgWarner Inc., Auburn Hills, MI (US)

(72) Inventors: Ronald P. Typinski, Macomb Township, MI (US); Dennis R. Que, Northville, MI (US); Scott J. Abramczyk, Rochester, MI (US)

(73) Assignee: BORGWARNER INC., Auburn Hills, MI (US)

( * ) Notice: Subject to any disclaimer, the term of this patent is extended or adjusted under 35 U.S.C. 154(b) by 465 days.

(21) Appl. No.: 14/413,245

(22) PCT Filed: Jul. 9, 2013

(86) PCT No.: PCT/US2013/049666
§ 371 (c)(1),
(2) Date: Jan. 7, 2015

(87) PCT Pub. No.: WO2014/014702
PCT Pub. Date: Jan. 23, 2014

(65) Prior Publication Data

US 2015/0167703 A1 Jun. 18, 2015

Related U.S. Application Data

(60) Provisional application No. 61/673,950, filed on Jul. 20, 2012.

(51) Int. Cl.

| | |
|---|---|
| ***F15B 15/28*** | (2006.01) |
| ***F15B 19/00*** | (2006.01) |
| *F15B 15/14* | (2006.01) |

(52) U.S. Cl.
CPC ..... *F15B 15/2861* (2013.01); *F15B 15/2807* (2013.01); *F15B 15/2892* (2013.01); *F15B 19/00* (2013.01); *F15B 15/1438* (2013.01)

(58) Field of Classification Search
CPC ..... F15B 15/2861
See application file for complete search history.

(56) References Cited

U.S. PATENT DOCUMENTS

| | | | |
|---|---|---|---|
| 3,643,551 | A | 2/1972 | Berg |
| 5,150,049 | A | 9/1992 | Schuetz |

(Continued)

FOREIGN PATENT DOCUMENTS

| | | | |
|---|---|---|---|
| DE | 19 60 181 | U | 5/1967 |
| JP | H 02-075499 | U1 | 6/1990 |

(Continued)

OTHER PUBLICATIONS

PCT International Search Report.

(Continued)

*Primary Examiner* — F. Daniel Lopez
(74) *Attorney, Agent, or Firm* — Howard & Howard Attorneys PLLC

(57) ABSTRACT

A piston actuator (10) includes a housing (12) having a hollow interior (12*a*) for enclosing a piston (14) defined by a head (14*a*) and a rod (14*b*). The piston (14) can reciprocate between first and second end limits of travel within the housing (12) and separates the housing (12) into first and second expandable fluid chambers (16*a*, 16*b*). The housing (12) has a rod-end opening (12*b*) at one end and a head-end opening (12*c*) at an opposite end. The piston (14) can include a longitudinally extending aperture (14*c*) formed therein with an open end (14*d*) facing the head-end opening (12*c*) of the housing (12). A magnet (18) can be supported by the piston (14) adjacent to the open end (14*d*) of the longitudinally extending aperture (14*c*) in the piston (14). A position sensor (20) can be supported by the housing (12) within the longitudinally extending aperture (14*c*) in the piston (14) adjacent to the magnet (18) for sensing the position of the piston (14) during movement between the first and second end limits of travel within the housing (12).

9 Claims, 4 Drawing Sheets

(56) References Cited

U.S. PATENT DOCUMENTS

| | | | | |
|---|---|---|---|---|
| 6,020,569 | A * | 2/2000 | Cecil | B23K 11/253 219/109 |
| 7,059,238 | B2 | 6/2006 | Albright et al. | |
| 7,520,208 | B2 * | 4/2009 | Beuth | F15B 15/1433 91/1 |
| 2005/0081710 | A1 | 4/2005 | Albright et al. | |

FOREIGN PATENT DOCUMENTS

| | | | |
|---|---|---|---|
| JP | H0755409 | A | 3/1995 |
| JP | H 10-37912 | A | 2/1998 |
| JP | 2000087919 | A | 3/2000 |
| JP | 2000-329112 | A | 11/2000 |
| JP | 2001090714 | A | 4/2001 |
| JP | 2004085578 | A | 3/2004 |

OTHER PUBLICATIONS

Machine-assisted English translation for DE 19 60 181 extracted from espacenet.com database on Jan. 9, 2017, 7 pages.
Partial machine-assisted English translation for JPH 02-075499 extracted from PAJ database on Jan. 6, 2017, 2 pages.
English language abstract and machine-assisted English translation for JPH 10-37912 extracted from espacenet.com database on Jan. 6, 2017, 16 pages.
English language abstract and machine-assisted English translation for JPH 2000-329112 extracted from espacenet.com database on Jan. 9, 2017, 20 pages.

* cited by examiner

INTERNAL POSITION SENSOR

FIELD OF THE INVENTION

The invention relates to an internal position sensor located inside of a piston actuator bore to function with various types of magnets and/or magnet materials, and more particularly, where the position sensor can be integrated into a plug or can be separate from the plug.

BACKGROUND

Position sensors are typically positioned externally with respect to the actuator being monitored. The external location of the position sensor can require the use of stronger, and expensive, rare earth magnet materials due to relatively large air gaps between the position sensor and the magnet material triggering the sensor. A piston actuator with external position sensor can be subject to seal failure due to magnetic contamination.

It would be desirable to provide an internal sensor to reduce a packaging footprint of the actuator. It would be desirable to decrease an air gap between the position sensor and the magnet triggering the position sensor. It would be desirable to replace rare earth magnets with less expensive materials. It would be desirable to increase a gap between the piston bore and magnet to reduce a risk of seal failure due to magnetic contamination.

SUMMARY

A sensor for determining a position of an actuator can include an elongate housing having a hollow interior formed therein with an opening at each end, and a piston defined by a head and a rod. The piston can be located within the housing for reciprocal movement between first and second end limits of travel. The rod of the piston can extend through a rod-end opening at one end of the housing. The piston can have a longitudinally extending aperture formed therein with an open end facing a head-end opening at an end of the housing opposite from the rod-end opening. A magnet can be supported by the piston adjacent to the open end of the longitudinally extending aperture in the piston. A position sensor can be supported by the housing within the longitudinally extending aperture in the piston for sensing a position of the piston along a path of travel within the housing.

An improvement to an actuator can include a housing having a hollow interior for enclosing a piston having a head and a rod. The piston can be located within the housing for reciprocation between first and second end limits of travel and separates the housing into first and second expandable fluid chambers. The housing can have a rod-end opening at one end and a head-end opening at an opposite end. The piston can have a longitudinally extending aperture formed therein with an open end facing the head-end opening of the housing. A magnet can be supported by the piston adjacent to the open end of the longitudinally extending aperture in the piston. A position sensor can be supported by the housing within the longitudinally extending aperture in the piston adjacent to the magnet for sensing a position of the piston along a path of travel within the housing.

An actuator can include a housing having a hollow interior, and a piston having a head and a rod. The piston can be located within the hollow interior of the housing for reciprocation between first and second end limits of travel within the housing. The piston can separate the housing into first and second expandable fluid chambers. The housing can have a rod-end opening at one end and a head-end opening at an opposite end. The piston can include a longitudinally extending aperture formed therein with an open end facing the head-end opening of the housing. A magnet can be supported by the piston adjacent to the open end of the longitudinally extending aperture in the piston. A position sensor can be supported by the housing within the longitudinally extending aperture in the piston adjacent to the magnet for sensing a position of the piston along a path of travel within the housing.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
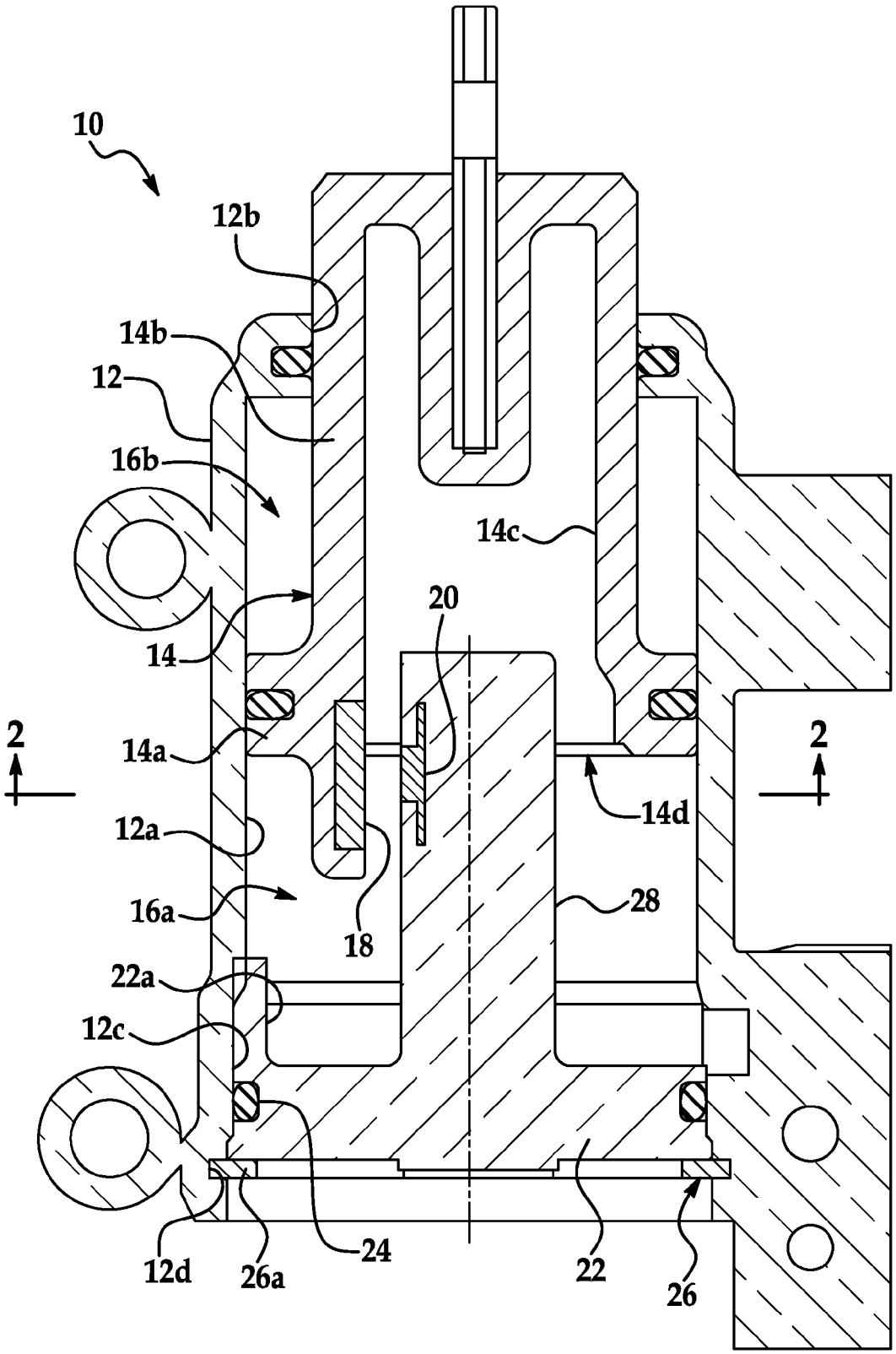
FIG. 1 is a cross sectional view of an actuator having a piston reciprocally enclosed within a hollow interior of a housing to define first and second expandable chambers, where a magnet is supported by the piston and a sensor is supported by the housing within the hollow interior to sense a position of the piston along a path of travel within the housing.
Figure 2:
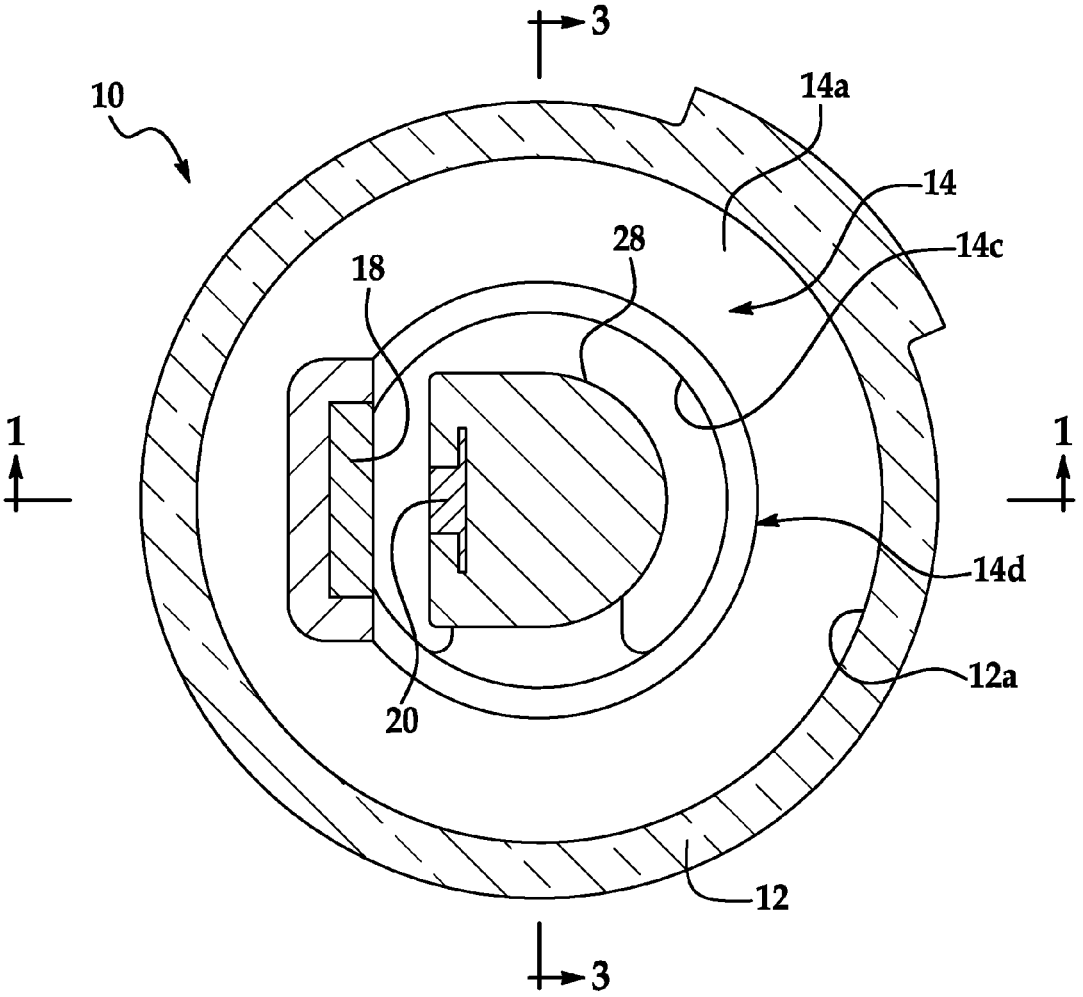
FIG. 2 is a cross sectional view of the actuator taken as shown in FIG. 1 illustrating the relationship of the magnet with respect to the sensor within a longitudinally extending aperture formed in the piston.

Referring now to FIGS. 1-5, an actuator 10 can include a housing 12 having a hollow interior 12*a* for enclosing a piston 14 having a head 14*a* and a rod 14*b*. The piston 14 can be located within the housing 12 for reciprocation between first and second end limits of travel. The piston 14 separates the housing 12 into first and second expandable fluid chambers 16*a* 16*b*. The housing 12 can have a rod-end opening 12*b* at one end and a head-end opening 12*c* at an opposite end. The piston 14 can have a longitudinally extending aperture 14*c* formed therein with an open end 14*d* facing the head-end opening 12*c* of the housing 12. A magnet 18 can be supported by the piston 14 adjacent to the open end 14*d* of the longitudinally extending aperture 14*c* in the piston 14. A position sensor 20 can be supported by the housing 12 within the longitudinally extending aperture 14*c* in the piston 14 adjacent to the magnet 18 for sensing a position of the piston 14 along a path of travel within the housing 12. As illustrated in FIG. 1, the sensor 20 senses the piston 14 in a position between the first and second end limits of travel within the housing 12. It should be recognized that the sensed position can be at any location along the path of travel, including the end limits of travel.

Figure 3:
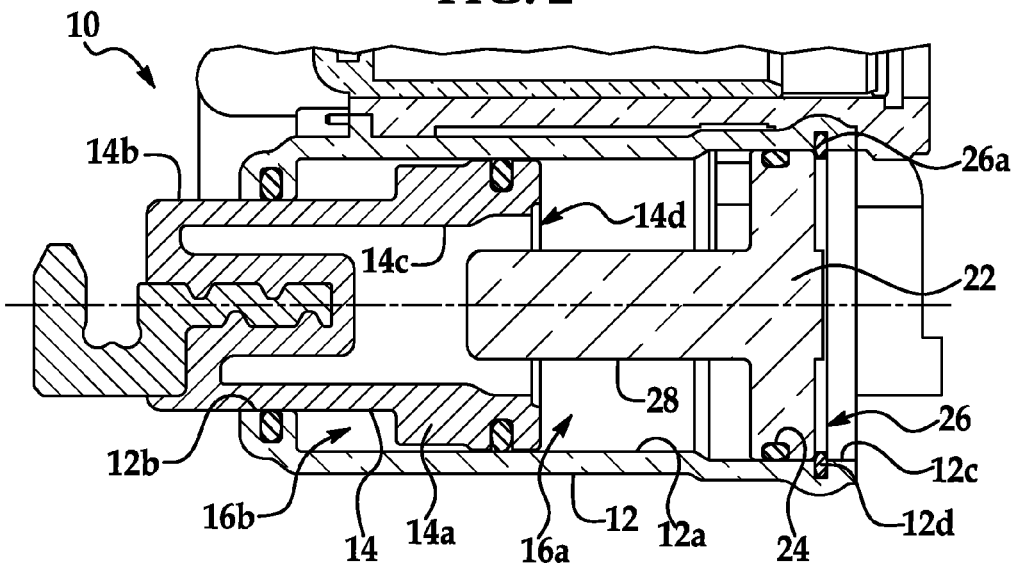
FIG. 3 is a cross sectional view of the actuator taken as shown in FIG. 2.
Figure 4:
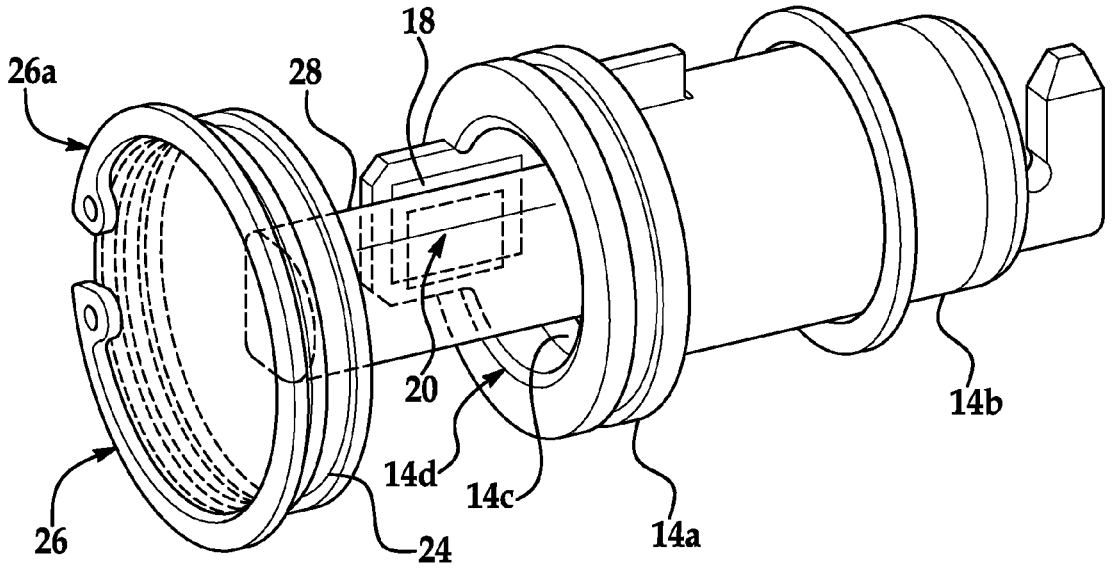
FIG. 4 is a perspective view of the piston and a plug supporting the position sensor.
Figure 5:
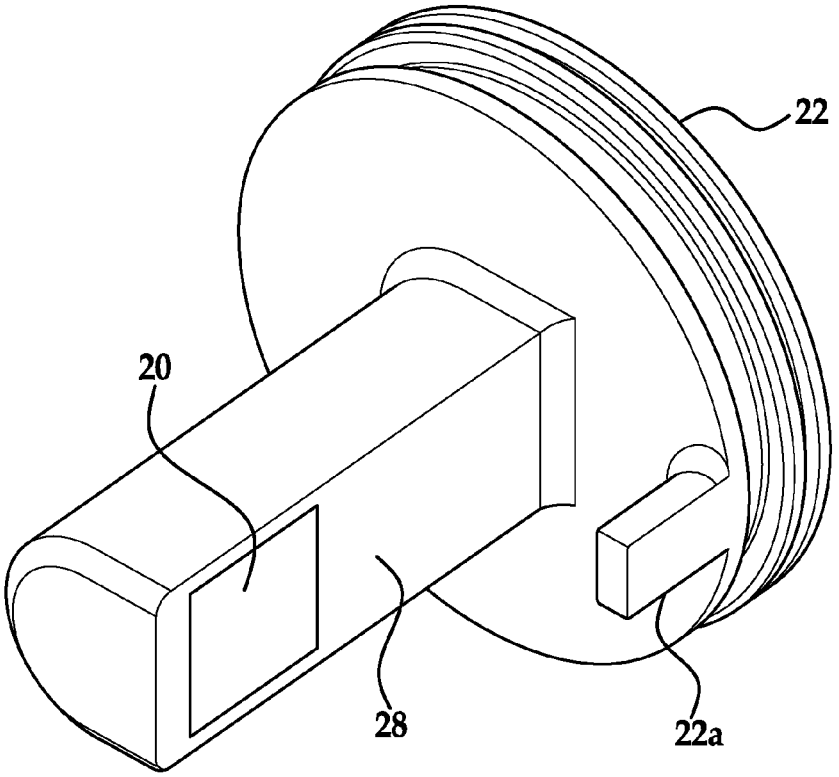
FIG. 5 is a perspective view of the plug supporting the position sensor and illustrating a clocking locator projection to orient the sensor with respect to the piston during assembly.

A plug 22 can be provided for closing the head-end opening 12*c* of the housing 12. The plug can support the position sensor 20 within the hollow interior 12*a* of the housing 12 and within the longitudinally extending aperture 14*c* in the piston 14 adjacent to the magnet 20 as the piston 14 moves between the first and second end limits of movement within the housing 12. As best seen in FIG. 5, a clocking locator 22*a* can be provided on the plug 22 to align the sensor 20 with the magnet 18 supported by the piston 14 during assembly. As best seen in FIGS. 1 and 3-5, a seal 24 can be supported by the plug 22 for sealing engagement with the head-end opening 12*c* at the end of the housing 12 opposite from the rod-end opening 12*b*. As best seen in FIGS. 1, 3 and 4, a retainer 26 can be provided for maintaining the plug 22 in an assembled relationship with respect to the housing 12. The retainer 26 can include a c-shaped retaining clip 26*a* engageable within a groove 12*d* formed in the housing 12 adjacent to the head-end opening 12*c* of the housing 12.

A sensor 20 is disclosed for determining a position of an actuator 10. The actuator 10 can include an elongate housing 12 having a hollow interior 12*a* formed therein with an opening 12*b*, 12*c* at each end. A piston 14 can be defined by a head 14*a* and a rod 14*b*. The piston 14 can be located within the housing 12 for reciprocal movement between first and second end limits of travel. The rod 14*b* of the piston 14 can extend through a rod-end opening 12*b* at one end of the housing 12. The piston 14 can have a longitudinally extending aperture 14*c* formed therein with an open end 14*d* facing a head-end opening 12*c* opposite from the rod-end opening 12*b* of the housing 12. A magnet 18 can be supported by the piston 14 adjacent to the open end 14*d* of the longitudinally extending aperture 14*c* in the piston 14. A position sensor 20 can be supported by the housing 12 within the longitudinally extending aperture 14*c* in the piston 14.

A plug 22 can be provided for closing the head-end opening 12 *c* of the housing 12. The plug can support the position sensor 20 within the hollow interior 12 *a* of the housing 12 and within the longitudinally extending aperture 14 *c* in the piston 14 adjacent to the magnet 20 as the piston 14 moves between the first and second end limits of movement within the housing 12. As best seen in FIG. 5, a clocking locator 22 *a* can be provided on the plug 22 to align the sensor 20 with the magnet 18 supported by the piston 14 during assembly. In particular, as best seen in FIGS. 1 and 3, the clocking locator 22 *a* angularly aligns the sensor 20 with the magnet 18 during assembly. As best seen in FIGS. 1 and 3-5, a seal 24 can be supported by the plug 22 for sealing engagement with the head-end opening 12 *c* at the end of the housing 12 opposite from the rod-end opening 12 *b*. As best seen in FIGS. 1, 3 and 4, a retainer 26 can be provided for maintaining the plug 22 in an assembled relationship with respect to the housing 12. The retainer 26 can include a c-shaped retaining clip 26 *a* engageable within a groove 12 *d* formed in the housing 12 adjacent to the head-end opening 12 *c* of the housing 12.

Figure 6:
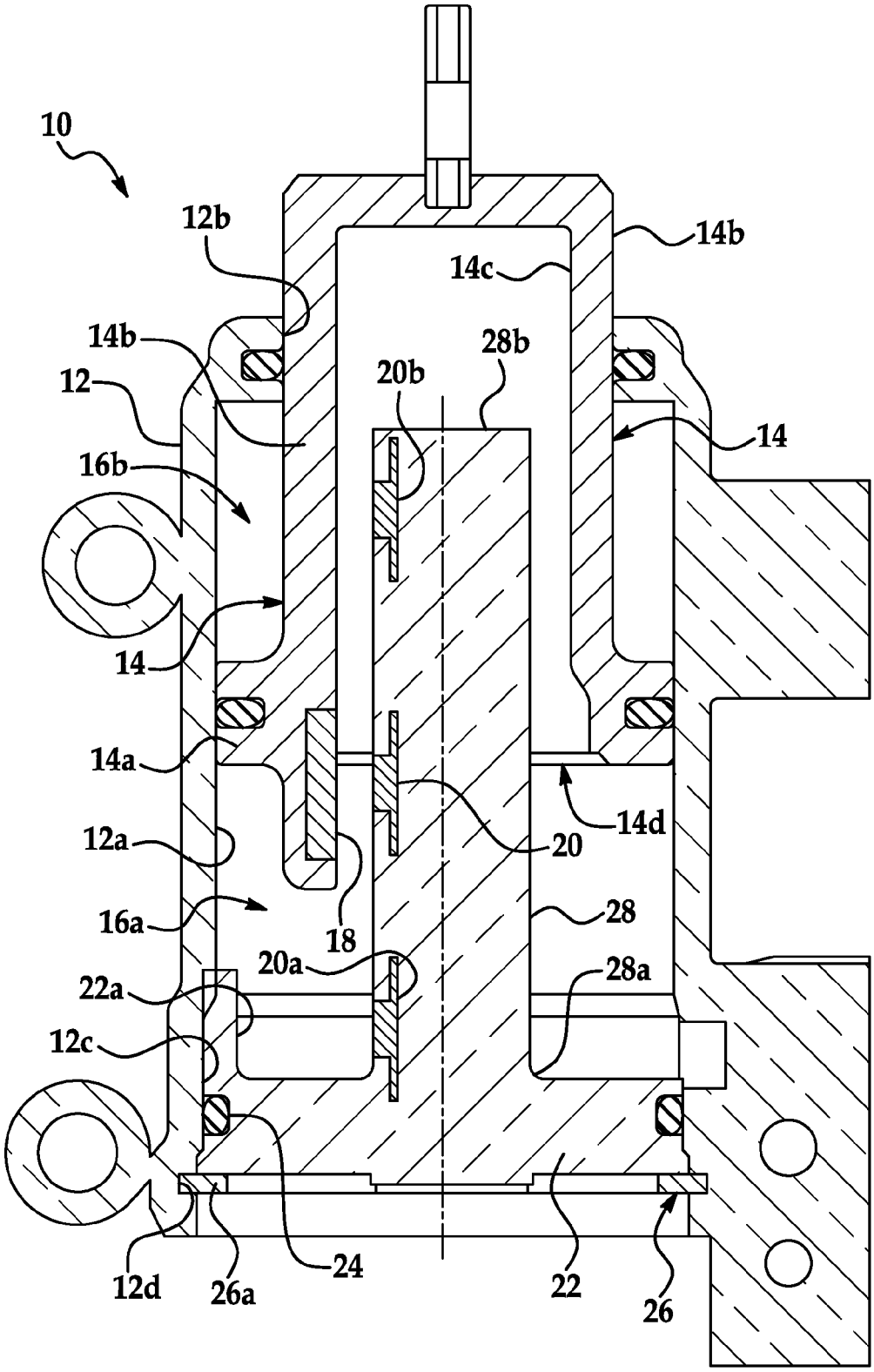
FIG. 6 is a cross sectional view of the actuator with a plurality of sensors for sensing multiple positions of the piston along the path of travel within the housing.

It should be recognized that additional sensors 20 can be mounted on an internally extending stub 28, if sensing of multiple positions of the piston 14 within the housing 12 is desired. By way of example and not limitation, as best seen in FIG. 6, a sensor 20*a* can be position adjacent a base 28*a* of the stub 28 to sense the piston 14 in a fully retracted position within the housing 12. By way of example and not limitation, a sensor 20*b* can be located at an outer end 28*b* of the stub 28 to sense the piston 14 in a fully extended position with respect to the housing 12. These positions for the sensor 20 can be used individually or in any combination. It should be recognized that additional sensors 20 can be mounted between the first and second end limits of travel to sense multiple positions along the path of travel. The sensors can be aligned with one another along the stub 28 for activation by a single magnet 18 as illustrated in FIG. 6. If desired, the sensors can be angularly offset with respect to one another and can be activated by a single annular magnet supported by the piston, or by separate magnets supported by the piston, either in an aligned relationship with respect to one another in a single plane or longitudinally spaced with respect to one another. The magnet or magnets 18 can be injection molded within a plastic piston 14. The sensor or sensors 20 can be injection molded into a plastic stub 28, which can be formed integrally as part of a plug 22 if desired. It should be recognized that the internal position of the sensor or sensors 20, 20*a*, 20*b* helps to protect the sensor or sensors 20, 20*a*, 20*b* from damage due to external forces or impacts during vehicle assembly and use. The internal position of the sensor or sensors 20, 20*a*, 20*b* reduces a packaging footprint of the actuator 10. It should be recognized that the disclosed configuration allows a decrease in the an air gap between the position sensor or sensors 20, 20*a*, 20*b* and the magnet 18 triggering the position sensor or sensors 20, 20*a*, 20*b*; and/or allows rare earth magnets to be replaced with less expensive magnetic materials; and/or allows an increase in a gap between the piston bore 12*a* and magnet 28 to reduce a risk of seal failure due to magnetic contamination.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An assembly for determining a position of an actuator (10) comprising:

an elongate housing (12) having a hollow interior (12*a*) formed therein with a rod-end opening (12*b*) at one end and a head-end opening (12*c*) at an opposite end;

a piston (14) defined by a head (14*a*) and a rod (14*b*), the piston (14) located within the housing (12) for reciprocal movement between first and second end limits of travel, the rod (14*b*) of the piston (14) extending through a rod-end opening (12*b*) of the housing (12), the piston (14) having a longitudinally extending aperture (14*c*) formed therein with an open end (14*d*) facing the head-end opening (12*c*) of the housing (12);

a magnet (18) supported by the piston (14) adjacent to the open end (14*d*) of the longitudinally extending aperture (14*c*) in the piston (14);

a position sensor (20);

a plug (22) connected to the housing (12) for closing the head-end opening (12*c*) of the housing (12), the plug (22) supporting the position sensor (20) within the hollow interior (12*a*) of the housing (12) and within the longitudinally extending aperture (14*c*) in the piston (14) adjacent to the magnet (18) as the piston (14) moves between the first and second end limits of travel within the housing (12); and a clocking locator (22*a*) to angularly align the position sensor (20) with the magnet (18) during assembly.

2. The assembly of claim 1 further comprising:

a seal (24) supported by the plug (22) for sealing engagement with the head-end opening (12*c*) of the housing (12) opposite from the rod-end opening (12*b*) of the housing (12).

3. The assembly of claim 1 further comprising:

a retainer (26) for maintaining the plug (22) in an assembled relationship with respect to the housing (12).

4. The assembly of claim 3, wherein the retainer (26) further comprises:

a c-shaped retaining clip (26*a*) engageable within a groove (12*d*) formed in the housing (12) adjacent to the head-end opening (12*c*) of the housing (12) opposite from the rod-end opening (12*b*) of the housing (12).

5. In an actuator (10) including a housing (12) having a hollow interior (12*a*) for enclosing a piston (14) having a head (14*a*) and a rod (14*b*), the piston (14) located within the housing (12) for reciprocation between first and second end limits of travel and separating the housing (12) into first and second expandable fluid chambers (16*a*, 16*b*), the housing (12) having a rod-end opening (12*b*) at one end and a head-end opening (12*c*) at an opposite end, the improvement comprising:

the piston (14) having a longitudinally extending aperture (14*c*) formed therein with an open end (14*d*) facing the head-end opening (12*c*) of the housing (12);

a magnet (18) supported by the piston (14) adjacent to the open end (14*d*) of the longitudinally extending aperture (14*c*) in the piston (14); and a position sensor (20) adjacent to the magnet (18) for sensing a position of the piston (14) along a path of travel within the housing (12); and a plug (22) connected to the housing (12) for closing the head-end opening (12*c*) of the housing (12), the plug (22) supporting the position sensor (20) within the hollow interior (12*a*) of the housing (12) and within the longitudinally extending aperture (14*c*) in the piston (14) adjacent to the magnet (18) as the piston (14) moves between the first and second end limits of travel within the housing (12); and a clocking locator (22*a*) to angularly align the position sensor (20) with the magnet (18) during assembly.

6. The improvement of claim 5 further comprising:

a seal (24) supported by the plug (22) for sealing engagement with the head-end opening (12*c*) of the housing (12).

7. The improvement of claim 5 further comprising:

a retainer (26) for maintaining the plug (22) in an assembled relationship with respect to the housing (12).

8. The improvement of claim 7, wherein the retainer further comprises:

a c-shaped retaining clip (26*a*) engageable within a groove (12*d*) formed in the housing (12) adjacent to the head-end opening (12*c*) of the housing (12).

9. An actuator (10) comprising:

a housing (12) having a hollow interior (12*a*); a piston (14) having a head (14*a*) and a rod (14*b*), the piston (14) located within the hollow interior (12*a*) of the housing (12) for reciprocation between first and second end limits of travel within the housing (12) and separating the housing (12) into first and second expandable fluid chambers (16*a*, 16*b*), the housing (12) having a rod-end opening (12*b*) at one end and a head-end opening (12*c*) at an opposite end, the piston (14) having a longitudinally extending aperture (14*c*) formed therein with an open end (14*d*) facing the head-end opening (12*c*) of the housing (12);

a magnet (18) supported by the piston (14) adjacent to the open end (14*d*) of the longitudinally extending aperture (14*c*) in the piston (14);

a position sensor (20) adjacent to the magnet (18);

a plug (22) connected to the housing (12) for closing the head-end opening (12*c*) of the housing (12), the plug (22) supporting the position sensor (20) within the hollow interior (12*a*) of the housing (12) and within the longitudinally extending aperture (14*c*) in the piston (14) adjacent to the magnet (18) as the piston (14) moves between the first and second end limits of travel within the housing (12);

a clocking locator (22*a*) to angularly align the position sensor (20) with the magnet (18) during assembly;

a seal (24) supported by the plug (22) for sealing engagement with the head-end opening (12*c*) of the housing (12) opposite from the rod-end opening (12*b*) of the housing (12); and a retainer (26) including a c-shaped retaining clip (26*a*) engageable within a groove (12*d*) formed in the housing (12) adjacent to the head-end opening (12*c*) of the housing (12) opposite from the rod-end opening (12*b*) of the housing (12) for maintaining the plug (22) in an assembled relationship with respect to the housing (12).

* * * * *